United States Patent [19]

Clin et al.

[11] 4,141,450

[45] Feb. 27, 1979

[54] METHOD AND APPARATUS FOR SORTING MIXTURES OF MATERIALS BY BALLISTIC EFFECT AND DIFFERENTIAL ADHERENCE

[75] Inventors: François H. Clin; Jean-Noel M. Gony, both of Orleans; François O. Proust, Olivet, all of France

[73] Assignee: Bureau de Recherches Geologiques et Minieres, Paris, France

[21] Appl. No.: 780,397

[22] Filed: Mar. 23, 1977

[30] Foreign Application Priority Data

Mar. 24, 1976 [FR] France ..... 76 08527

[51] Int. Cl.[2] ..... B07C 5/02; B07C 9/00

[52] U.S. Cl. ..... 209/3.1; 209/930; 209/932; 209/637; 209/693; 209/700; 209/629

[58] Field of Search ..... 209/73, 114, 115, 119, 209/75

[56] References Cited

U.S. PATENT DOCUMENTS

| | | | |
|---|---|---|---|
| 1,246,572 | 11/1917 | Elliott | 209/114 |
| 3,384,233 | 5/1968 | Bolles | 209/92 |
| 3,757,945 | 9/1973 | Keiter | 209/114 |

*Primary Examiner*—Allen N. Knowles

*Attorney, Agent, or Firm*—Sughrue, Rothwell, Mion, Zinn and Macpeak

[57] ABSTRACT

The sorting method includes moving materials at a certain horizontal speed such that on falling their points of impact are disbursed over a moving sorting belt in such a manner that the materials become located at points which are sufficiently different to enable effective sorting to be obtained by small adhesion differences so that the adhering materials are carried by the sorting belt to a discharge region and the non-adhering or weakly adhering materials are rejected by the belt. The apparatus includes a feed device located above a moving adhesion belt having an adjustable speed control and an arrangement for adjusting the position of the feed device relative to the adhesion sorting belt.

10 Claims, 3 Drawing Figures

METHOD AND APPARATUS FOR SORTING MIXTURES OF MATERIALS BY BALLISTIC EFFECT AND DIFFERENTIAL ADHERENCE

The invention relates to a sorting apparatus for separating into two separate groups, items of different type, shape and particle size distribution forming part of mixtures of the most heterogeneous type, and in particular for separating the most varied materials comprising flexibility or rigidity differences.

The need for such separation may arise in very different industries, but it is particularly required in the recovery of refuse, and in particular before the incineration of domestic and/or industrial refuse. The invention thus relates to the separation of hollow items, plastic films, bottles, papers, metal packing, rags and any heterogeneous mixture of this type, which may thus include a large number of phases.

Sorting devices have long been known using a ballistic effect, the treated items being divided according to the distance of their points of impact or their rebound. In these devices, which are excellent when the treated items possess very marked characteristics which facilitate their distinction, the conveyor projecting the materials to be sorted must travel at high speed in the more usual cases, and this generally leads to pulling of the belt and to the materials rolling on the belt, thus falsifying the sorting to be obtained. This defect may be remedied to a certain extent by increasing the fall height, but a limitation on accuracy is very quickly reached because of the impossibility in practice of increasing the overall size of the installation beyond a certain amount. To these limitations must be added the feed and recovery difficulties for the materials, so that the method is not convenient for sorting materials requiring a large fall height in order to differentiate between materials having small differences in fall velocity.

Sorting by differences in the adhesion to an appropriate surface of the items to be sorted also enables excellent results to be attained, but on condition that the difference in density of the treated materials is large, that they are of similar size and their particle size distribution is fine. In the opposite case, for example in the case of a mixture of different types of refuse, the result would be more mediocre. One could obviously use preliminary crushing and screening, but in addition to the high investment necessary, the energy consumption would be considerable.

The present invention firstly provides a sorting method in which the materials are moved at a certain horizontal speed such that on falling, their points of impact are dispersed over a moving sorting belt, in such a manner that the materials become located at points and at speeds which are sufficiently different to enable effective sorting to be obtained by adhesion differences even where these are small, the adhering materials being carried by the sorting belt to a discharge region and the non-adhering or weakly adhering materials being rejected by the belt, either by rebounding or by rolling or sliding on the belt.

The combined effect of the ballistic fall and impacts on the adhesion belt enable not only all the aforesaid disadvantages relating to simple sorting by ballistic effects to be avoided, but the method also enables excellent results to be obtained without the need for preliminary crushing or screening or inopportune increase in the speeds of the feed device or the adhesion sorting belt. The combination of the resultant speeds at the points of impact also modifies the adhesion characteristics and in this manner it is possible to fix at will the desired cut or phase separation.

A reliable method is thus obtained for effectively sorting the most varied items without the need for considerable energy consumption.

The invention also provides an apparatus for effecting the aforesaid method, characterised by comprising a feed device and an adhesion sorting belt situated at a lower level, the apparatus also comprising means for varying the initial speed of the materials projected above the adhesion belt.

This variation in both speed and direction, by adjusting the speed of the feed device and its inclination, has the advantage of increasing the range of choice of the desired cut, both with regard to the chosen phases and to the particle size distribution — fine or coarse — of the chosen phases. The feed device may be a belt, a channel or a vibrating grid, the jutting portion of a screen or generally any outlet channel from a processing apparatus situated immediately upstream.

The invention further provides an apparatus for effecting the aforesaid method, characterised by comprising means for adjusting the difference in level between the feed device for the products and the adhesion sorting belt, and means for adjusting the amount by which said belt is covered by the feed device, the sorting belt being equipped with means for adjusting its speed and its inclination.

By way of example, plastic bottles mixed with old paper and plastic film have been separated in this manner by using a horizontal feed belt moving at a speed of 60 meters per minute, the sorting belt being inclined at 40° to the horizontal and moving at 100 meters per minute. The fall height was 70 cm.

Likewise, using a similar setting, broken glass has been extracted from refuse, the sorting being such as to collect only glass pieces of sufficient size to enable them to be used as cullet.

Such an apparatus has the advantage of comfortably obtaining fine selection by differential adhesion, by adjusting the points of impact of the rigid items on the adhesion sorting belt, which may also be fitted with means for facilitating the rebound of such items. To this end, a rigid plate is provided under the belt and close thereto directly below the chosen impact position, so that the impact of the items to be sorted is followed by rapid ejection of the rigid items, so enabling the other materials to be easily sorted as a function of their adhesion, without the feed and sorting device having prohibitive speeds. The adhesion qualities may be raised to a high level by simple treatment such as wetting, electrification, heating or cooling, either of the belt or of the elements to be sorted.

The invention will now be described by way of example with reference to the accompanying drawings wherein.

Figure 1:
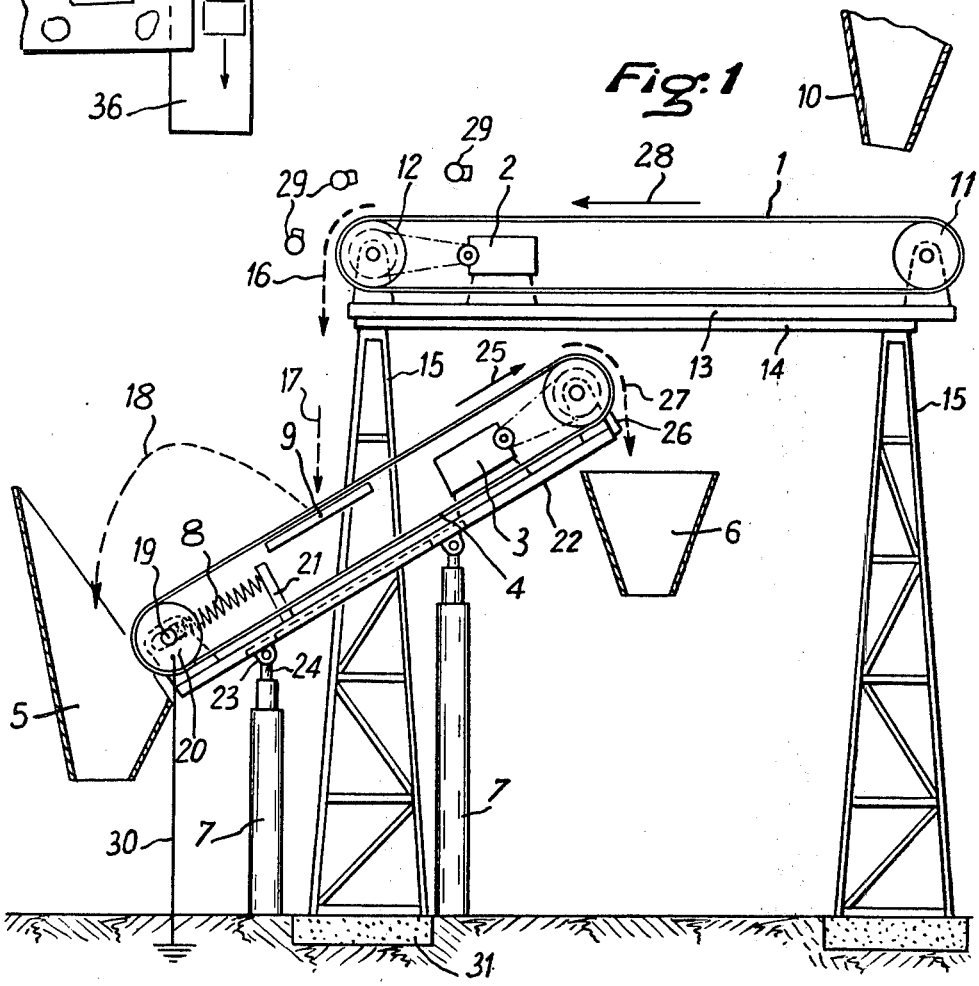
FIG. 1 is a partly sectional diagrammatic elevation of one embodiment of the apparatus.

The feed device for the products to be sorted shown in FIG. 1 is constituted by a belt 1 driven by a variable speed geared motor 2 allowing speed adjustment of the items dumped on the belt by any known device and of which the dumping rate may be variable and adjustable. Such a device is represented diagrammatically by the hopper 10. The assembly formed by the variable speed unit 2 and the rollers 11 and 12 supporting the belt 1 is rigid with a frame 13 which slides by means of rollers, not shown, on the base 14 rigid with the uprights 15.

In this manner, it is simple to adjust the position of the points of impact on the sorting belt 4 of any required phase forming part of the simple or complex mixture dumpled by the feed device 10.

Although the discharge of the items from the feed device 1 is represented on the drawing by a simple arrow 16, it will be apparent that the horizontal speed of the items, assumed to be fairly large, which is represented by 28 and which is the same when the items leave the feed device, i.e. the belt 1 in the present case, may fall very rapidly in the case of certain items, so that only certain items fall vertically as shown by the arrow 17. In contrast, if the speed of discharge from the belt 1 is low, all the items fall vertically but the dense items fall more rapidly, and generally having no adhesion rebound from the belt 4, as indicated by the arrow 18, to fall into the hopper 5. Thus the sorting belt 4 is able to receive all the items, whether these be items having close adhesion properties or very different adhesion properties, on its different portions without it being necessary to drive it at high speed, thus allowing any desired selection. This selection is still better if the items adhering to the belt 4 are driven in counter-current.

In order to accelerate items which have a tendency to roll on the feed belt 1, a jack or any other similar device may be provided to incline the frame 13 relative to the base 14, the arrow 28 then taking on a certain inclination.

The rebound effect for rigid items may be increased by a plate 9 situated below the sorting belt 4 in the region of impact of these items, and the speed and inclination of this belt may be adjusted by the variable speed geared motor 3 and jacks 7.

The rebound and adhesion effect may also be adjusted by the tension in the adhesion sorting belt 4. Simple adjustment means are represented diagrammatically for varying the tension in the belt 4. Compression springs 8 repel the axle 19 of the roller 20 and rest on the plate 21, which is of adjustable position.

The jacks 7 or any other equivalent device, such as a telescopic screw fitting, not only allow the inclination of the frame 22 to be adjusted but also the fall height for the items. In order not to overload the drawing, only the connection lugs 23 at the ends of the rods 24 of the jacks 7 are shown, the lugs 23 being fixed to the frame 22 through any easily adjustable positioning slots, fixing then being made by clamping the lugs on to the frame 22 using simple nuts and bolts.

The apparatus constructed in this manner thus allows not only the accuracy of the desired phase separation to be influenced, but also in a large number of cases the actual quality of separation within the same phase as a function of the size of the items, part of the initial mixture falling in the hopper 5 either exclusively by rebound or by rebound and/or rolling on the adhesion belt 4, the other part 27 being entrained by adhesion in the direction of the arrow 25 into the hopper 6.

It is apparent that the described apparatus may comprise numerous auxiliary devices according to the type of adhesion chosen, an appropriate deflector 26 enabling the adhering items not evacuated with the part 27 to be driven back towards the hopper 6.

This adhesion may be obtained using a simple belt of flexible material or may be induced by a thermal, capillary or purely mechanical effect.

By way of example, the sorting belt 4 may consist of a flexible polyester belt, or a belt of an elastomer material. Alternatively, it may be of metal and consist of a solid metal sheet, a grid, bars or wires and generally be adapted to the type of items treated.

If a thermal effect is to be used, the belt may be either cooled or heated. In this latter case, it can collect thermoplastic materials in the viscinity of their softening point. Conversely, organic materials may be cooled to bring them close to their freezing point.

Where the phases in the hopper 10 are of different degrees of humidity, this differential humidity may be utilised to accentuate the adhesion difference between the phases.

If this is not so, either sprinkling, differential humidification at the level of the feed device 1, or simple humidification of the belt 4 may be provided. The sprinkling and humidification means are of well known type, such as a fixing ramp, sprinkling devices with fixed or rotating brushes such as those used in automatic car washes etc., and have not been shown for clarity of the drawing.

If the mixture to be sorted comprises items of different electrostatic behaviour due to different resistivities, the mixture is passed in front of one or more corona effect electrodes diagrammatical illustrated at 29, so as to electrify the least conducting particles and increase their adhesion on the belt 4 which then serves as the earth electrode for the electric field 30 representing the earth connection for the sorting belt 4. The potential of the electrodes 29 relative to the earth 30 may for example be of the order of 10,000 to 40,000 volts. To this end, the feed device 1 is insulated by insulating fittings 31 provided in particular at the base of the uprights 15.

According to one modification, the adhesion of triboelectrically charged particles of the reverse polarity to that arising on the belt 4 may be accentuated by a friction system also disposed at 26, the belt 4 being constituted or lined with a strongly electrostatic substance such as teflon. By this means, the repulsion and ejection of the items of the same triboelectric polarity as the belt 4 is increased.

Figure 2:
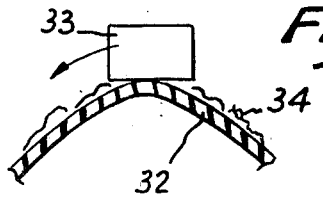
FIG. 2 is a diagrammatic cross-section through a sorting belt suitable for separating flexible items from more or less rigid items.

Finally, the adhesion sorting belt may be of any special structure adapted to the form of individual phases in the mixture. For example, as rebound is always obtained by the direct impact on the plate 9, a convex belt 32 shown in FIG. 2 could be used to facilitate evacuation down its sides of all items not possessing the required adhesion. Thus a box 33 is immediately rejected down the sides while a rag 34 remains on the belt.

Although only one embodiment of an apparatus for effecting the method has been described heretofore, it is apparent that modifications may be made to all or part of the structures, which have been indicated by way of example only, or operation can take place in a gas other than air without leaving the scope of the invention. This gas could be ozone in particular when it is required to sterilise the items. The gas is recycled with or without filtering in order to limit consumption. If the items are very oxidisable, nitrogen may be used in order to prevent their degradation.

Figure 3:
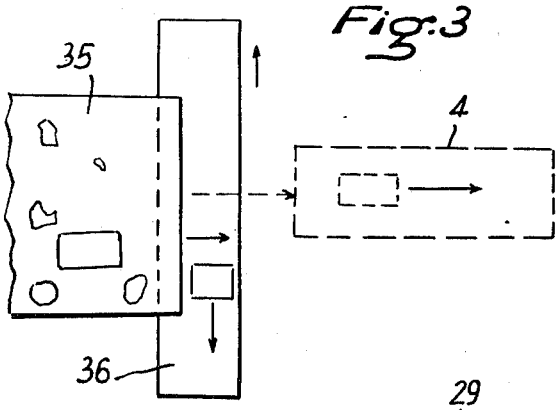
FIG. 3 is a diagrammatic representation of one modification of the apparatus of FIG. 1.

Likewise, the arrangement of the feed device 1 and sorting belt 4 may vary as shown in FIG. 3, in which a sorting belt 4 running along the axis of the feed device 35 is shown with dashed lines and a belt 36 of the same type is shown in a transverse direction. This crossed assembly may be of advantage where the feed device 35 distributes the products in a direction along which they would tend to remain on a sorting belt 4 disposed along the axis of 35, the ejected products rolling in contrast on to the transverse belt shown at 36. The feed device 35 may be any process apparatus such as a trommel, or in the limit a simple feed spout directly upstream of the sorting belt.

The sorting belt may in the limit also be replaced by a drum, in particular where the belt could be short or its speed high.

Summarising, the method allows a very wide and selective sorting even though very varied phases may be present, and its practical embodiment may be reduced to a simple apparatus without undue energy consumption.

What we claim is:

1. A method for sorting material in a heterogeneous mixture of materials of different types and forms and having a particle size and rigidity distribution extending over a wide range comprising conveying said heterogeneous mixture of materials at a predetermined speed along a substantially horizontal conveyor, discharging said material from the end of said conveyor onto an inclined conveyor having the higher end thereof disposed beneath said horizontal conveyor, collecting the materials which do not adhere to the inclined conveyor in a container adjacent the lower end of the inclined conveyor, conveying the materials which adhere to said inclined conveyor upwardly in a direction having a horizontal component of movement opposite to the horizontal component of movement of said substantially horizontal conveyor and having a vertical component of movement substantially opposite to the direction of fall of the materials discharged from the end of said horizontal conveyor and collecting the materials discharged from the higher end of said inclined conveyor.

2. A method as set forth in claim 1 comprising varying the inclination of said inclined conveyor to vary the degree of adhesion of materials to said inclined conveyor.

3. A method as set forth in claim 1 further comprising varying the tension of said inclined conveyor to vary the degree of adhesion of materials thereto.

4. A method as set forth in claim 1 further comprising varying the distance of the inclined conveyor below said horizontal conveyor to vary the degree of adhesion of materials thereto.

5. An apparatus for sorting materials in a heterogeneous mixture of materials of different types and forms and having a particle size and rigidity distribution extending over a wide range comprising substantially horizontally disposed conveyor means for moving said heterogeneous mixture of materials horizontally at a predetermined speed, inclined conveyor means disposed beneath one end of said horizontal conveyor means for receiving material discharged from said one end of said horizontal conveyor means, said inclined conveyor means having the higher end thereof disposed beneath said horizontal conveyor means and operable to convey material falling thereon upwardly in a direction having a horizontal component opposite to the direction of movement of said horizontal conveyor, collector means disposed adjacent the lower end of said inclined conveyor for receiving material which does not adhere to said inclined conveyor and additional collector means disposed beneath the higher end of said inclined conveyor for receiving material adhering to said inclined conveyor.

6. An apparatus as set for in claim 5 further comprising means for varying the speed of said horizontal conveyor means to vary the trajectories of the material discharged therefrom.

7. An apparatus as set forth in claim 5 further comprising means for varying the distance of said inclined conveyor means beneath said horizontal conveyor means and for varying the angle of inclination of said inclined conveyor means relative to said horizontal conveyor means.

8. An apparatus as set forth in claim 5 further comprising rigid plate means disposed beneath that portion of said inclined conveyor means upon which said materials fall.

9. An apparatus as set forth in claim 5 further comprising electrode means disposed adjacent said horizontal conveyor means for imparting an electric charge to said material being conveyed thereby.

10. An apparatus as set forth in claim 5 further comprising friction means for increasing the triboelectric characteristics of said inclined conveyor means.

* * * * *